US009146025B2

(12) United States Patent
Beausoleil

(10) Patent No.: US 9,146,025 B2
(45) Date of Patent: Sep. 29, 2015

(54) LED LAMP CONVERSION MODULE

(71) Applicant: David M. Beausoleil, Ridgewood, NJ (US)

(72) Inventor: David M. Beausoleil, Ridgewood, NJ (US)

(73) Assignee: Mind Head LLC, Ridgewood, NJ (US)

( * ) Notice: Subject to any disclaimer, the term of this patent is extended or adjusted under 35 U.S.C. 154(b) by 329 days.

(21) Appl. No.: 13/761,135

(22) Filed: Feb. 6, 2013

(65) Prior Publication Data

US 2013/0235598 A1 Sep. 12, 2013

Related U.S. Application Data

(60) Provisional application No. 61/595,242, filed on Feb. 6, 2012.

(51) Int. Cl.

| | |
|---|---|
| ***F21V 19/00*** | (2006.01) |
| ***F21V 21/00*** | (2006.01) |
| ***F21V 29/00*** | (2015.01) |
| ***F21K 99/00*** | (2010.01) |
| *F21S 8/08* | (2006.01) |
| *F21Y 101/02* | (2006.01) |
| *F21V 29/89* | (2015.01) |

(52) U.S. Cl.
CPC . *F21V 21/00* (2013.01); *F21K 9/30* (2013.01); *F21V 29/20* (2013.01); *F21S 8/08* (2013.01); *F21V 29/89* (2015.01); *F21Y 2101/02* (2013.01); *Y10T 29/49117* (2015.01)

(58) Field of Classification Search
CPC ..... F21K 9/10; F21Y 2101/02
USPC ..... 362/249.01, 249.02, 294, 153.1
See application file for complete search history.

(56) References Cited

U.S. PATENT DOCUMENTS

| | | | | |
|---|---|---|---|---|
| 5,463,280 | A | 10/1995 | Johnson | |
| 5,949,347 | A | 9/1999 | Wu | |
| 6,550,950 | B1 | 4/2003 | Fernandez | |
| 6,739,734 | B1 | 5/2004 | Hulgan | |
| 6,791,840 | B2 | 9/2004 | Chun | |
| 6,883,941 | B2 * | 4/2005 | Cutting | 362/371 |
| 7,153,008 | B2 | 12/2006 | Grote, III et al. | |
| 7,192,155 | B2 * | 3/2007 | Morrow et al. | 362/153.1 |
| 7,347,706 | B1 | 3/2008 | Wu et al. | |
| 7,488,097 | B2 | 2/2009 | Reisenauer et al. | |
| 8,083,373 | B2 | 12/2011 | Zimmerman et al. | |
| 8,167,459 | B2 * | 5/2012 | Wang | 362/294 |
| 8,926,138 | B2 * | 1/2015 | Reed et al. | 362/294 |
| 8,926,139 | B2 * | 1/2015 | Reed et al. | 362/294 |
| 2002/0114170 | A1 * | 8/2002 | Chen et al. | 362/559 |
| 2006/0250803 | A1 * | 11/2006 | Chen | 362/373 |
| 2010/0134046 | A1 * | 6/2010 | Holder et al. | 315/297 |
| 2010/0290254 | A1 * | 11/2010 | Howard et al. | 362/641 |

* cited by examiner

*Primary Examiner* — Ali Alavi
(74) *Attorney, Agent, or Firm* — Doherty IP Law Group LLC

(57) ABSTRACT

An LED lamp conversion module for converting an outpost lighting fixture from incandescent or halogen lighting to LED lighting, the conversion module including a base and an LED lamp attached to the base, where the LED lamp has at least one LED. Electronics are adapted to illuminate the at least one LED of the LED lamp when powered with a current. The conversion module also includes an electronic connection member in electrical communication with the electronics. The conversion module may be used to replace an incandescent or halogen lamp in an outpost lighting fixture by connecting the base to the outpost lighting fixture and connecting the electronic connection member to a power source of the outpost lighting fixture.

20 Claims, 4 Drawing Sheets

LED LAMP CONVERSION MODULE

CROSS-REFERENCE TO RELATED APPLICATIONS

The present application claims the benefit of U.S. Provisional Application Ser. No. 61/595,242 filed Feb. 6, 2012, the disclosure of which is incorporated by reference herein.

BACKGROUND OF THE INVENTION

The present invention relates to lighting devices, and in particular, conversion modules that may be used to retrofit existing incandescent or halogen lamps in decorative low voltage landscape lighting fixtures with more efficient light emitting diode ("LED") lights.

For many years business and homeowners have installed path lighting at ingress and egress locations on their property, both for aesthetics and safety. Historically, that lighting consisted of a series of electrically interconnected lighting outposts each comprising one or more incandescent or halogen lamps. Today, there are available more efficient LED lamps that use +/−1/20th the power of an incandescent light and last +/−20 years, all while outputting a comparable number of lumens as an incandescent lamp. However, heretofore there has been no way to retrofit the ubiquitous existing incandescent or halogen decorative low voltage landscape lighting fixture outposts with the more efficient LED lamps.

BRIEF SUMMARY OF THE INVENTION

The present invention solves this problem by providing an LED lamp conversion module that can be used to replace existing incandescent or halogen lamps in lighting outposts or path light fixtures, while retaining use of the existing fixture outpost stem, stake, and housing itself. The module may be used module may be used in a single light outpost in a system, multiple light outposts, or all of the light outposts in the system, while retaining functionality of all outposts. The module may also fit into many different existing styles of light outposts. This modularity is a great benefit as it means that the existing lights can be quickly and easily upgraded as the need arises and budget permits rather than in mass. Of course, all of the outposts in a particular system can be retrofitted at once if desired.

This modularity also has big advantages for the lighting distributor. First, the distributor only needs to keep modules in stock and not entire integrated LED walkway path light fixtures. This frees up large amounts of shelf space and inventory dollars because the distributor essentially can keep the old less expensive halogen or incandescent fixture in inventory and can choose to upgrade to high technology LED without having to stock an imbedded/integrated large stock of LED light source light fixtures along with the stock of old incandescent/halogen path light fixtures. Also, because the modules can be used in many different existing light types, the inventory of modules can be turned over rapidly. This rapid turnover of inventory allows the distributor to keep up to date LED products in stock and since this is an evolving technology and changing quickly a distributor having the newest and greatest technology is advantageous. Lastly, modularity allows the distributor the option to transport modules in small packages that can be sent to a customer rather than sending an entire LED light outpost which is both bulkier and heavier, and thus more costly to ship.

In one embodiment, an LED conversion lamp comprises an LED lamp conversion module for converting an outpost lighting fixture from incandescent or halogen lighting to LED lighting comprises a base, an LED lamp attached to the base, the LED lamp having at least one LED, electronics adapted to illuminate the at least one LED of the LED lamp when powered with a current, and an electronic connection member in electrical communication with the electronics. The LED conversion module may be used to replace an incandescent or halogen lamp in an outpost lighting fixture by connecting the base to the outpost lighting fixture and connecting the electronic connection member to a power source of the outpost lighting fixture.

The electronic connection member may comprise a plug sized and configured to fit within an S8 Wedge-Base socket.

The current may be a low voltage current. The current may be in the range of 8-24 volts.

The at least one LED may be two LEDs.

The base may be manufactured from metal and act as a heat sink for the at least one LED.

The electronic connection member may comprise a plug sized and configured to fit within an S8 Wedge-Base socket.

The base may be configured to fit within one of a plurality of outpost lighting fixtures, wherein the plurality of outpost lighting fixtures each has a different configuration.

Light emitted from the at least one LED is not directly viewable by a viewer of average height when observing the illuminated outpost lighting fixture from a standing position.

The base may be substantially circular in configuration and wherein the LED lamp conversion module further comprises a pair of sockets arranged on the base. If so provided, the sockets may each include a slot. The sockets may be arranged 180° apart. A first post may be arranged 90° apart from each socket and a second post may be arranged 180° apart from the first post. The electronic connection member may include a plug sized and configured to fit within an S8 Wedge-Base socket. The base may be manufactured from a metal that acts as a heat sink for the at least one LED.

In accordance with another embodiment of the present invention, a method of converting an outdoor perimeter lighting fixture from use with an incandescent or halogen lamp to use with an LED lamp may include the steps of removing the incandescent or halogen lamp from the lighting fixture, installing an LED lamp conversion module comprising a base with an associated LED, electronics adapted to provide illuminating power to the LED, and an electrical connector extending from the electronics, and connecting the electrical connector to the outdoor perimeter lighting fixture.

The electrical connector may be a plug sized and configured to fit within an S8 Wedge-Base socket. The base may act as a heat sink to dissipate heat from the LED.

The installing step may include attaching sockets of the LED lamp conversion module to sockets of the lighting fixture. If so included, the method may further comprise affixing a top hat of the lighting fixture upon the LED lamp conversion module.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof, will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

With respect to the drawings.

DETAILED DESCRIPTION

Figure 1:
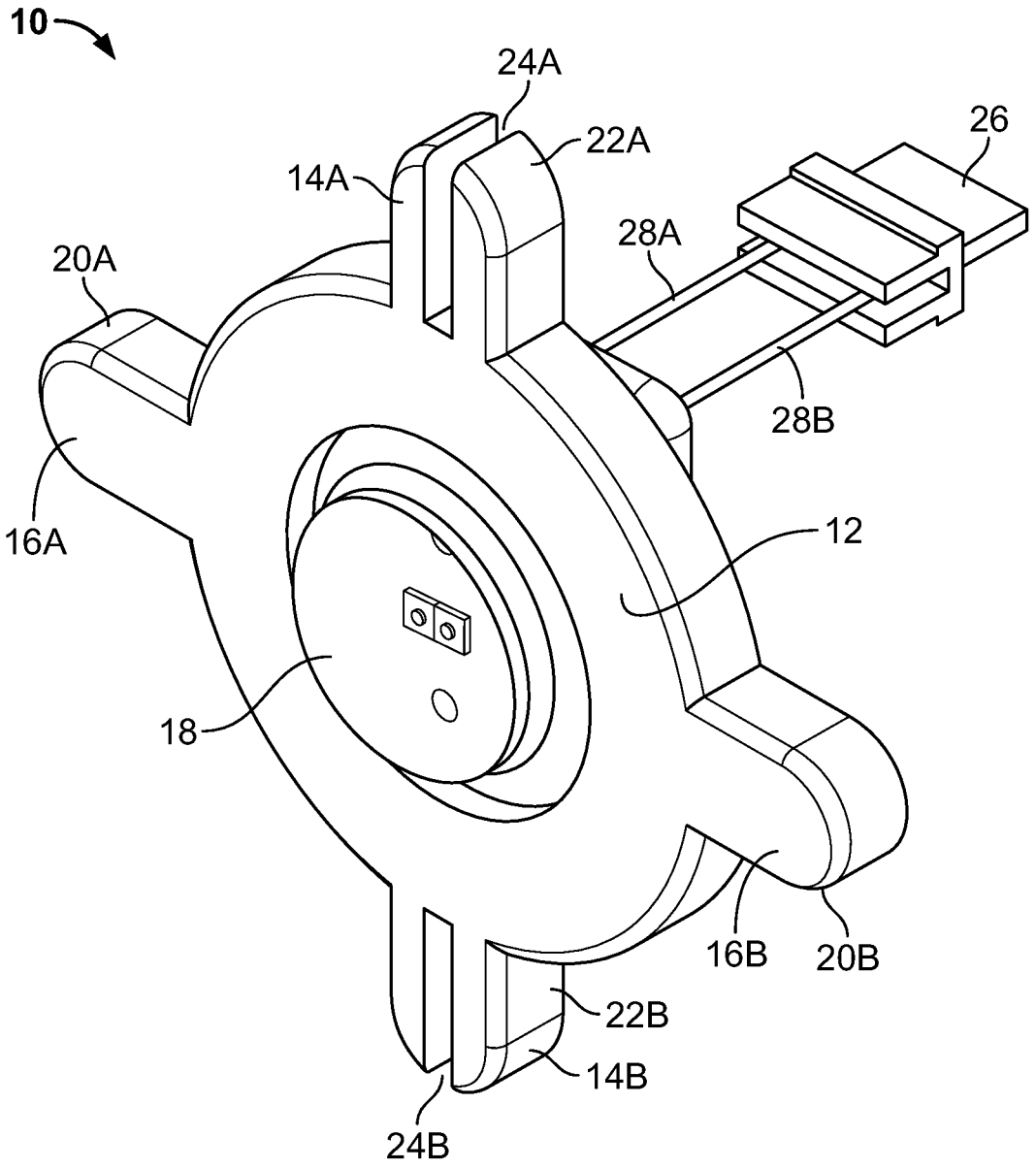
FIG. 1 depicts a perspective view of a LED lamp conversion module in accordance with one embodiment of the present invention.

In the following are described the preferred embodiments of the LED lamp conversion modules of the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose. Where like elements have been depicted in multiple embodiments, identical reference numerals have been used in the multiple embodiments for ease of understanding.

Details of the invention may be appreciated by considering the entirety of the submission herein. Generally, however, one embodiment of the LED lamp conversion module is shown in FIG. 1. As shown, the LED lamp conversion module 10 comprises a base 12 that includes sockets 14A, 14B and posts 16A, 16B that can be fitted into an existing lighting outpost. The LED lamp conversion module 10 also includes electronics 18 and LED lamp module 30. As is known in the art, the electronics 18 provide the requisite circuitry to illuminate LEDs 40 in the LED lamp module 30, preferably with standard low voltage current in the range of 8-24 volts AC or DC.

Going back to the base 12, it is shown in FIG. 1 that the base may be generally circular. This shape is preferred although other geometric and non-geometric shapes may also be utilized.

It will be appreciated that the sockets 14A, 14B and posts 16A, 16B are shown in FIG. 1 as being alternating and located approximately 90° from each other. This arrangement facilitates connection with a large number of existing lighting outposts, although other arrangements may be provided.

It will also be appreciated that the posts 16A, 16B are configured as solid structures. That is, the posts each include a continuous perimeter 20A, 20B. In the meantime, the sockets 14A, 14B each include a discontinuous perimeter 22A, 22B separated by a slot 24A, 24B. The slots 24A, 24B aid in connection of the LED lamp conversion module 10 to existing lighting outposts as will be discussed.

Also provided in the LED lamp conversion module 10 of FIG. 1 is an electronic connection member, such as plug 26 connected to the electronics 18 via a pair of leads 28A, 28B.

Figure 2:
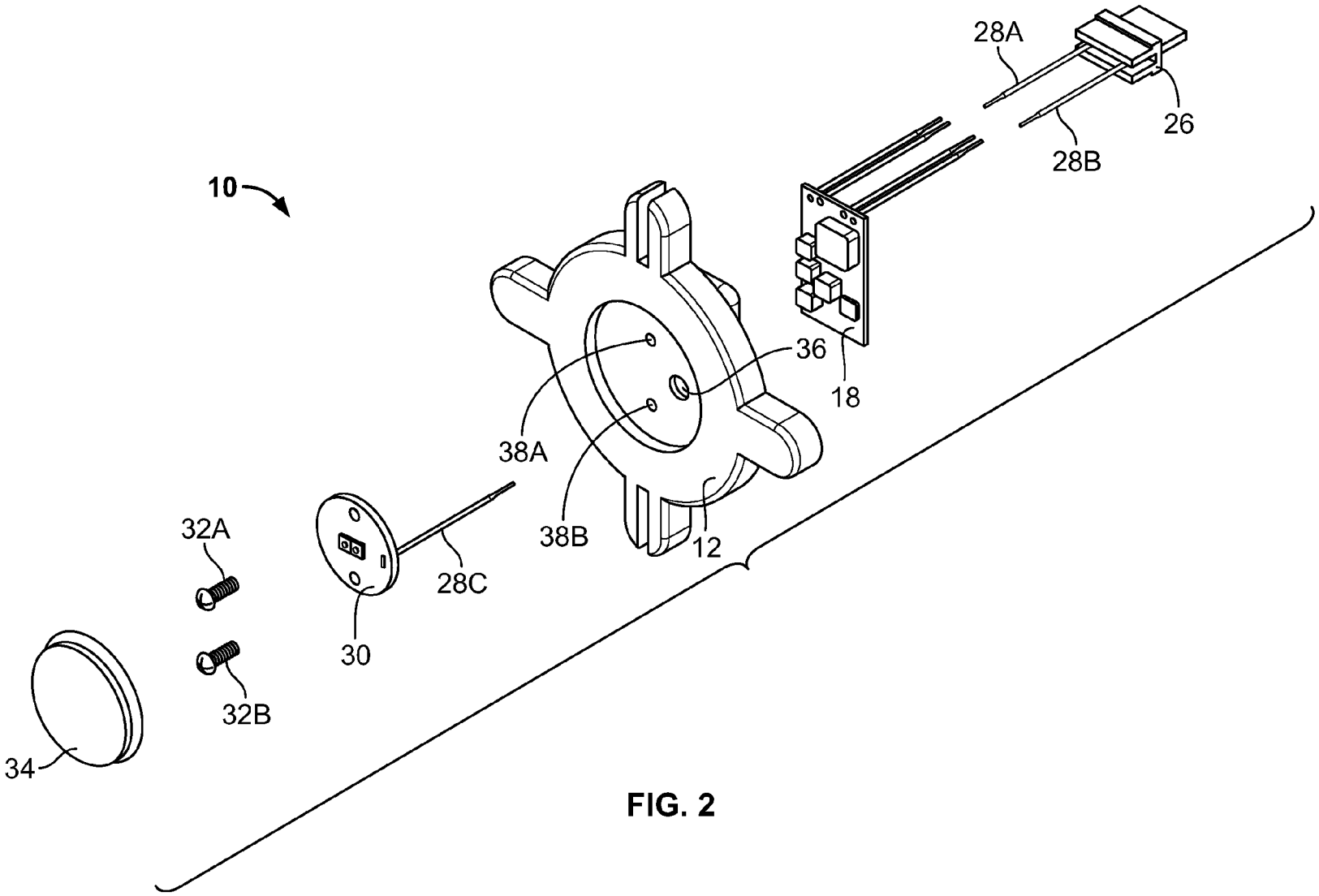
FIG. 2 depicts an exploded view of the LED lamp conversion module of FIG. 1.

FIG. 2 depicts an exploded view of the LED lamp conversion module 10. Shown are the arrangements of, from right to left as viewed, the plug 26, leads 28A, 28B, electronics 18, base 12, lamp module 30, fasteners 32A, 32B, such as screws, and a lens 34.

It will be appreciated that the plug 26 is connected to the electronics through the leads 28A, 28B. The leads are typically configured as light gauge wire, 18 gauge or less. The electronics are in turn connected to the base 12 with an adhesive, not shown, such as an epoxy compound or similar material that provides the thermal transmission of heat generated by the LED and LED driver as well as providing encapsulated environmental protection for the circuit boards. The LED module 30 is in turn connected to the base 12, on a side opposite of the electronics 18, via tapped threads 38A, 38B sized and configured to accept the screws 32A, 32B. Thermally conductive grease, or thermal gap pad, neither shown, is typically applied between the LED module 30 and the base 12. A third lead 28C, forming part of the LED module 30, passes through an aperture 36 of the base 12 and connects to the electronics 18 to provide to the LEDs 40. Lastly, the lens 34, typically configured from press borosilicate glass, acrylic, or other non-opaque substance, it connected to the base 12, over the LED module 30, with RTV silicone or other sealing adhesive.

Figure 3:
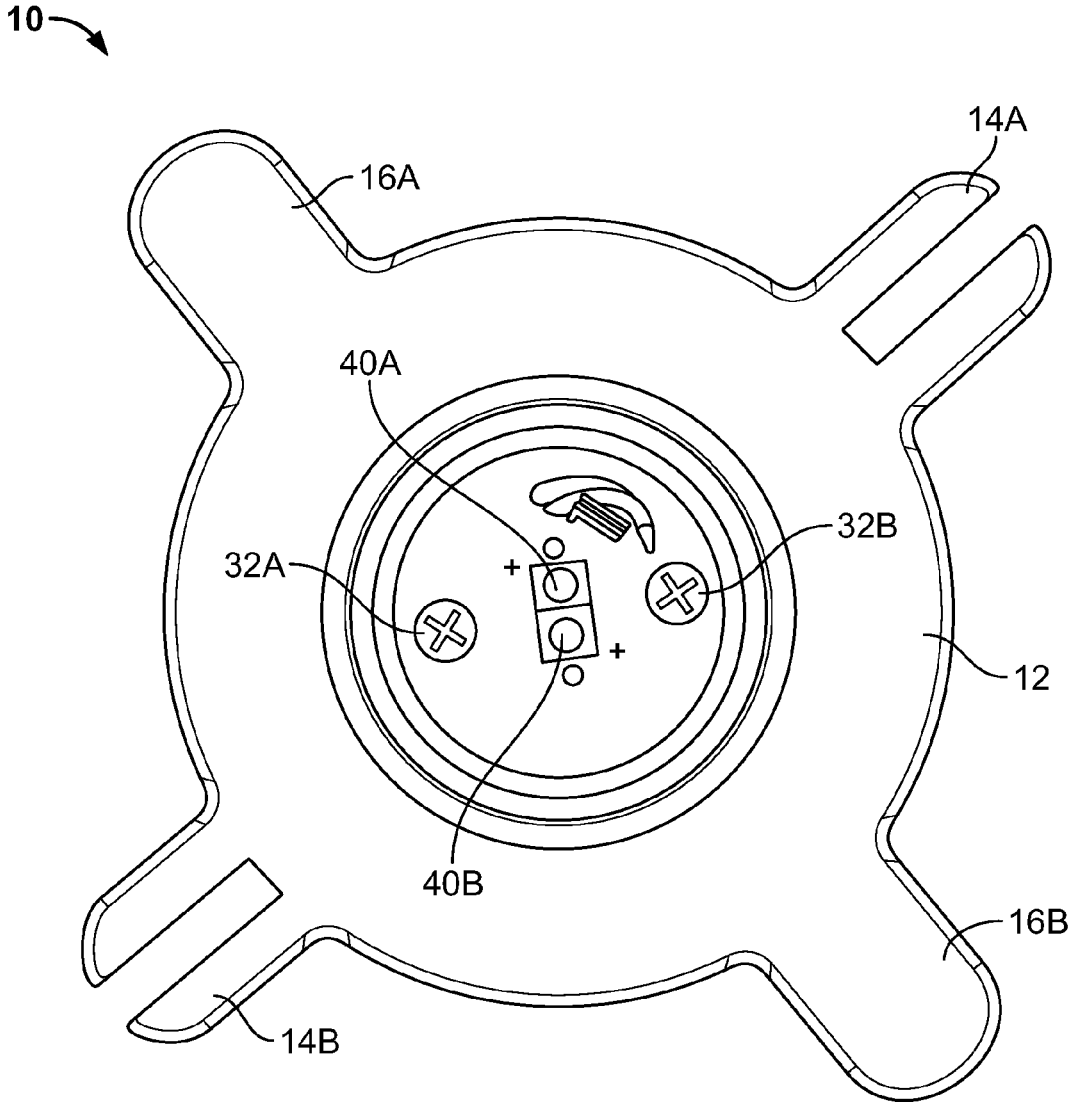
FIG. 3 depicts a plan view of the LED lamp conversion module of FIG. 1.

FIG. 3 depicts a detailed view of the LED lamp conversion module 10 in plan view. In the embodiment shown, there are two LEDs 40A, 40B, although one or more than two may be provided.

Figure 4:
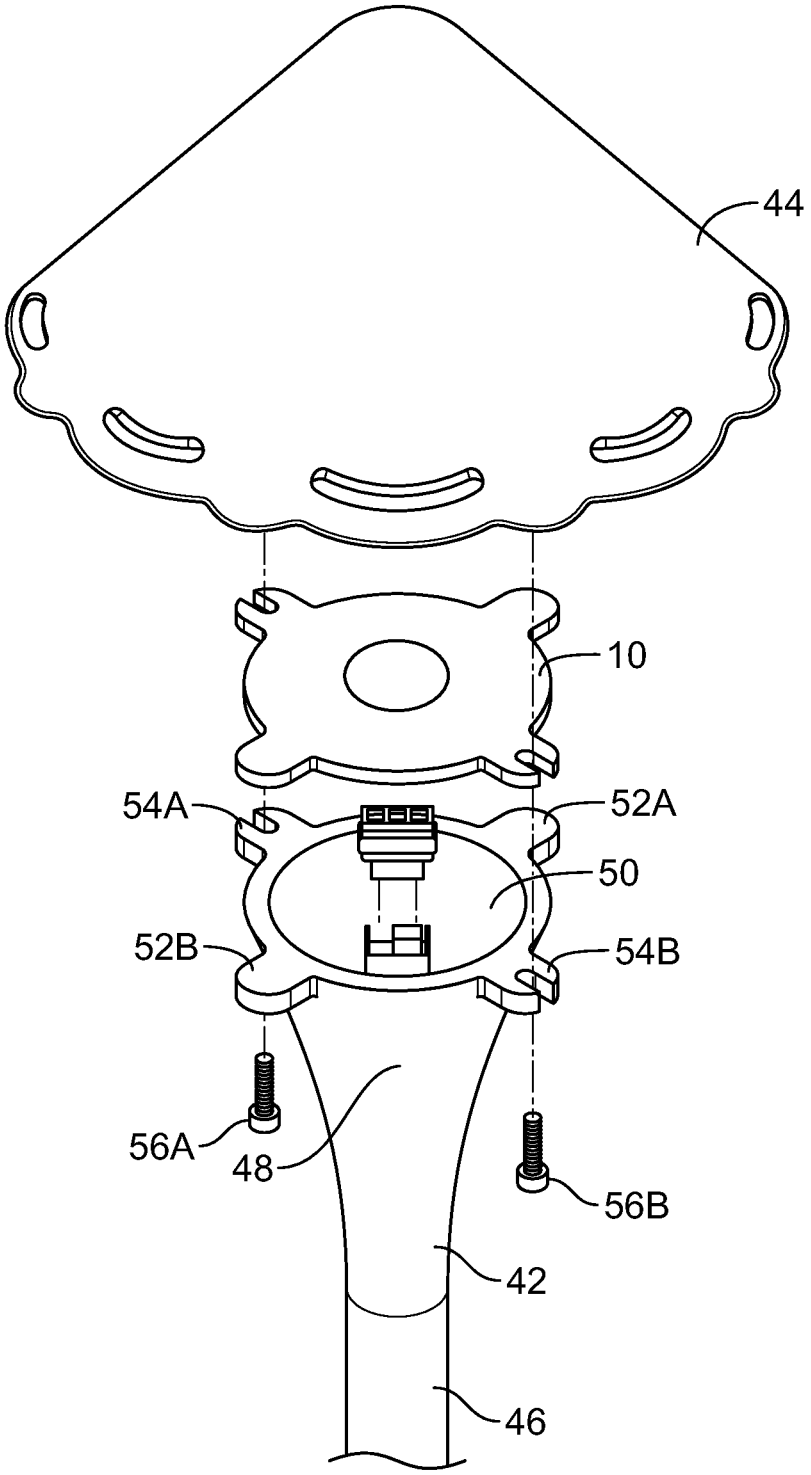
FIG. 4 depicts an exploded view of an LED lamp conversion module being retrofitted into a convention lamp outpost.

FIG. 4 depicts an overview of the retrofitting of a light outpost. Typically, a light outpost comprises a lower section 42 and top hat 44. As shown, the lower section 42 typically includes a post 46 which tapers upward to form a vase 48. The vase 48 includes an open top 50 with posts 52A, 52B and sockets 54A, 54B for connecting a lighting module (in one case the LED lamp conversion module 10) thereto. The top hat 44 is configured to fit over the post 46 and lighting module in both a decorative and functional manner. In terms of decoration, the top hat can be configured to different shapes and sizes as the designer chooses. However, functionally, it is preferred that an underside, not shown, of the top hat 44 be reflective to spread light emitted from the lighting module evenly and maximally. As shown in FIG. 4, the LED lamp conversion module 10 of the present invention may be fitted between the top hat 44 and vase 48 by aligning the respective sockets 14A, 14B, 52A, 52B and securing same with fasteners 56A, 56B threaded into the underside of the top hat 44. In some embodiments, the top hat 44 may overlap the vase 48 or come very close thereto.

Before securing the fasteners 56A, 56B, however, the lamp module should be connected electronically to the vase 48. In the example of the LED light conversion module 10, the module connects simply and efficiently to the existing power source socket with plug 26. Preferably, this plug is in the form of an S8 plug sized and configured to fit within a conventional S8 Wedge-Base socket.

Because the base 12 is typically manufactured from a metal that transmits heat such as Zinc Aluminum, it acts as a heat sink for the LED lights. This feature draws heat from the LEDs and extends their useful life. The heat is also dissipated with the contact between the top hat 44 and lower vase 42. It also permits the use of high powered LEDs such as Cree® LEDs. Cree® is a registered trademark of Cree, Inc., 4600 Silicon Drive, Durham, N.C. 27703.

LED lamps installed in the perimeter lighting may mimic the look of typical incandescent (or halogen) lights by matching the intensity and color temperature. Typically this color temperature is in the range of 2,700K-3,300K. Alternatively, the LED light may have color temperatures that are warmer or cooler. These color temperatures are typically in the range of 3,000K-5,000K, but may also dip below that range. The LED's may also be colored LEDs, for example casting off colors such as red, blue, or green. The owner of such perimeter lighting may then effectively change the color of the lamps periodically if so desired, for example seasonally.

Because the LEDs of the present invention may focus emitted light into the underside of the top hat 44, and due to their placement in relation to the top hat, light emitted from the LEDs may be reflected downward toward the ground level rather than be visible directly from the LED by a viewer of average height (approximately 5'-0" to 6'-0") when observing the illuminated outpost lighting fixture from a standing position. In this case, the viewer cannot directly see the source of light reducing the distracting nature of lights not having such a feature.

In order to retrofit a conventional lighting outpost from use with an incandescent or halogen lamp to use with an LED lamp, one simply has to remove the top hat and incandescent or halogen lamp from the lighting fixture and install an LED lamp conversion module as described herein. Such installation may be completed by attaching the LED lamp conversion module to the lighting outpost via the sockets provided on the LED lamp conversion module and connecting its plug to the socket of the lighting outpost. The top hat may then be replaced.

Although the invention herein has been described with reference to particular embodiments, it is to be understood that these embodiments are merely illustrative of the principles and applications of the present invention. It is therefore to understood that numerous modifications may be made to the illustrative embodiments and that other arrangements may be devised without departing from the spirit and scope of the present invention as defined by the appended claims.

The invention claimed is:

1. An LED lamp conversion module for converting an outpost lighting fixture from incandescent or halogen lighting to LED lighting, the conversion module comprising:

a base;

an LED lamp attached to said base, the LED lamp having at least one LED, wherein said base is made of metal that acts as a heat sink for transmitting heat generated by said at least one LED;

electronics adapted to illuminate said at least one LED of said LED lamp when powered with a current;

an electronic connection member in electrical communication with said electronics;

said outpost lighting fixture including a post having an open top;

wherein said LED conversion module replaces an incandescent or halogen lamp in said outpost lighting fixture by connecting said base to said open top of said outpost lighting fixture and connecting the electronic connection member to a power source of said outpost lighting fixture, wherein said metal base draws heat away from said at least one LED and dissipates the heat via contact between said metal base and said open top of said outpost lighting fixture.

2. The LED lamp conversion module of claim 1, wherein said electronic connection member comprises a plug sized and configured to fit within an S8 Wedge-Base socket.

3. The LED lamp conversion module of claim 1, wherein said current is a low voltage current.

4. The LED lamp conversion module of claim 3, wherein said current is in the range of 8-24 volts.

5. The LED lamp conversion module of claim 1, wherein said at least one LED is two LEDs.

6. The LED lamp conversion module of claim 1, wherein said base is configured to fit within one of a plurality of outpost lighting fixtures, wherein said plurality of outpost lighting fixtures each has a different configuration.

7. The LED lamp conversion module of claim 1, wherein light emitted from said at least one LED is not directly viewable by a viewer of average height when observing the illuminated outpost lighting fixture from a standing position.

8. The LED lamp conversion module of claim 1, wherein said base is substantially circular in configuration and wherein said LED lamp conversion module further comprises a pair of sockets arranged on said base.

9. The LED lamp conversion module of claim 8, wherein said sockets each include a slot.

10. The LED lamp conversion module of claim 9, wherein said sockets are arranged 180° apart.

11. The LED lamp conversion module of claim 10, further comprising a first post arranged 90° apart from each socket and a second post arranged 180° apart from said first post.

12. Currently amended) A method of converting an outdoor perimeter lighting fixture from use with an incandescent or halogen lamp to use with an LED lamp, comprising:

removing the incandescent or halogen lamp from the lighting fixture;

installing an LED lamp conversion module comprising a base with an associated LED, electronics adapted to provide illuminating power to said LED, and an electrical connector extending from said electronics;

connecting said electrical connector to said outdoor perimeter lighting fixture, wherein said electrical connector is a plug sized and configured to fit within an S8 Wedge-Base socket, and wherein said base acts as a heat sink to dissipate heat from said LED.

13. The method of claim 12, wherein said installing step includes attaching sockets of the LED lamp conversion module to sockets of the lighting fixture.

14. The method of claim 13, further comprising affixing a top hat of the lighting fixture upon the LED lamp conversion module.

15. An LED lamp conversion module for converting an outpost lighting fixture from incandescent or halogen lighting to LED lighting, the conversion module comprising:

an outpost lighting fixture including a post that tapers upwardly to form a vase having an open top;

a metal base;

an LED lamp attached to said metal base, the LED lamp having at least one LED, wherein said metal base acts as a heat sink for transmitting heat generated by said at least one LED;

electronics adapted to illuminate said at least one LED of said LED lamp when powered with a current;

an electronic connection member in electrical communication with said electronics;

wherein, said LED conversion module replaces an incandescent or halogen lamp previously installed in said outpost lighting fixture by connecting said base to said open top of said vase and connecting said electronic connection member to a power source of said outpost lighting fixture, wherein said metal base sits atop said open top of said vase, said metal base drawing heat away from said at least one LED and dissipating the heat via the contact between said metal base and said open top of said vase.

16. The LED lamp conversion module of claim 15, wherein said open top of said vase includes a pair of opposing sockets and a pair of opposing posts including a first socket with a first slot, a first post located 90 degrees from said first socket, a second socket with a second slot located 90 degrees from said first post and 180 degrees from said first socket, and a second post located 90 degrees from said second socket and 180 degrees from said first post, wherein said base has a pair of opposing sockets and a pair of opposing posts including a first socket with a first slot, a first post located 90 degrees from said first socket of said base, a second socket with a second slot located 90 degrees from said first post of said base and 180 degrees from said first socket of said base, and a second post located 90 degrees from said second socket of said base and 180 degrees from said first post of said base, wherein said base is connected with said open top of said vase so that said first and second sockets of said base are aligned and in contact with said first and second sockets of said open top and so that said first and second posts of said base are aligned and in contact with said first and second posts of said open top, and wherein heat generated by said at least one LED is transferred from said base to said open top of said vase via the contact between said base and said top including said aligned posts and said aligned sockets.

17. The LED conversion module of claim 1, wherein said post tapers upwardly to form a vase including said open top having a pair of opposing sockets and a pair of opposing posts including a first socket with a first slot, a first post located 90 degrees from said first socket, a second socket with a second slot located 90 degrees from said first post and 180 degrees from said first socket, and a second post located 90 degrees from said second socket and 180 from said first post, wherein said base has a pair of opposing sockets and a pair of opposing posts including a first socket with a first slot, a first post located 90 degrees from said first socket of said base, a second socket with a second slot located 90 degrees from said first post of said base and 180 degrees from said first socket of said base, and a second post located 90 degrees from said second socket of said base and 180 degrees from said first post of said base, and wherein said base is connected with said open top of said vase so that said first and second sockets of said base are aligned and in contact with said first and second sockets of said open top and so that said first and second posts of said base are aligned and in contact with said first and second posts of said open top.

18. The LED conversion module of claim 17, further comprising:

a first fastener passing through said first socket of said open top and said first socket of said base; and a second fastener passing through said second socket of said open top and said second socket of said base, wherein said first and second fasteners secure said base to said open top of said vase.

19. The LED conversion module of claim 18, further comprising a top hat overlying said base and said open end of said vase, wherein said first and second fasteners are threaded into an underside of said top hat, and wherein heat generated by said at least one LED is dissipated by said top hat via contact between said base and said top hat.

20. The LED conversion module of claim 17, wherein said first and second sockets at said open top of said vase project away from one another and said first and second posts at said open top of said vase project away from one another, and wherein said first and second sockets of said base project away from one another and said first and second posts of said base project away from one another.

* * * * *